US005383345A

United States Patent [19]

Kallinger-Prskawetz-Jacobsen

[11] Patent Number: 5,383,345

[45] Date of Patent: Jan. 24, 1995

[54] FLAT KEY WITH INTERCHANGEABLE SHAFT

[76] Inventor: Christine Kallinger-Prskawetz-Jacobsen, Thaliastrasse 38, A-1160 Wien, Austria

[21] Appl. No.: 42,717

[22] Filed: Apr. 5, 1993

[30] Foreign Application Priority Data

Apr. 9, 1992 [AT] Austria ..... 748/92

[51] Int. Cl.[6] ..... E05B 19/04

[52] U.S. Cl. ..... 70/395; 70/408; 403/294

[58] Field of Search ..... 70/395, 408, 460; 403/294, 297

[56] References Cited

U.S. PATENT DOCUMENTS

| | | | |
|---|---|---|---|
| 2,298,697 | 10/1942 | Hofmann | 70/395 |
| 3,267,707 | 8/1966 | Adams | 70/395 |
| 3,797,291 | 3/1974 | Keine | 70/395 |
| 3,841,120 | 10/1974 | Gartner | 70/408 X |
| 3,955,725 | 5/1976 | Rese | 70/460 X |
| 4,432,218 | 2/1984 | Hoener | 70/395 |
| 4,901,548 | 2/1990 | Deslandes | 70/408 |
| 4,998,952 | 3/1991 | Hyatt, Jr. et al. | 70/408 X |
| 5,058,465 | 10/1991 | Womack | 70/408 X |
| 5,099,665 | 3/1992 | Terada | 70/408 |
| 5,131,247 | 7/1992 | Hsu | 70/408 X |
| 5,207,082 | 5/1993 | LeMaitre | 70/408 |
| 5,211,044 | 5/1993 | Kim | 70/395 X |
| 5,272,895 | 12/1993 | Best | 70/408 X |

FOREIGN PATENT DOCUMENTS

| | | | |
|---|---|---|---|
| 1107529 | 8/1981 | Canada . | |
| 0114326 | 8/1984 | European Pat. Off. . | |
| 1204266 | 1/1960 | France . | |
| 2448607 | 10/1980 | France | 70/408 |

*Primary Examiner*—Lloyd A. Gall
*Attorney, Agent, or Firm*—Ladas & Parry

[57] ABSTRACT

In order to increase the value of a key, in particular a flat key, e.g. a car key, the head of the key is manufactured of noble metal and releasably connected to the shaft 1 of the key. For connecting the shaft 1 to the head 2 a snap-locking mechanism is employed, which is brought about by pins 8 adapted to be inserted through holes of the head 2 and the shaft 1 and a clamping plate 6 which is insertable into the head 2. The technical effect of the key, which is adapted to be assembled, resides in the fact that when the vehicle is changed the head may be interchanged for a key of a different vehicle type or a different lock. It is also possible for the noble metal to be reused for other purposes.

4 Claims, 1 Drawing Sheet

FLAT KEY WITH INTERCHANGEABLE SHAFT

BACKGROUND OF THE INVENTION AND PRIOR ART

The invention relates to a flat key comprising a flat head and a shaft adapted to be inserted into the former and to be releasably fixed therein.

Flat keys of this type have been disclosed in Canadian Patent No. 1,107,529. In that flat key the head is composed of a recessed bottom member and a cover member which closes off the recess, the key being fixed in the recess. The design of the head in two parts results in a comparatively cumbersome manufacture and assembly of the key.

GENERAL DESCRIPTION OF THE INVENTION

An object of the invention is the provision of means by which these disadvantages can be overcome and whereby further the possibility is afforded to manufacture the key head of noble metal and the key shaft from the usual materials, since keys of this nature are frequently employed as car keys, in which case the user frequently has a desire to upgrade the quality of the key.

This object is attained with a key of the aforesaid type in that the head is made in one piece, preferably of noble metal, e.g. gold, and the shaft is adapted to be inserted into a slot entering from the narrow side of the head, the shaft and the head comprising matching apertures through which pins associated with a small plate adapted to be applied onto the head can be inserted to bring about a releasable connection of the shaft to the head.

This affords the possibility, for example when purchasing a new motor car, to fit the head after the removal of the shaft to a different shaft or, in the event that the key is no longer needed, to use it as a raw material for other purposes, e.g. for the production of jewellery.

Details of the invention will be further explained with reference to the drawing in which an embodiment of the key is selected which provides for a releasable connection between the shaft and the head.

BRIEF DESCRIPTION OF THE DRAWINGS

There is shown in FIG. 1 an assembled flat key in plan view.

DESCRIPTION OF SPECIFIC EMBODIMENT

Figure 1:
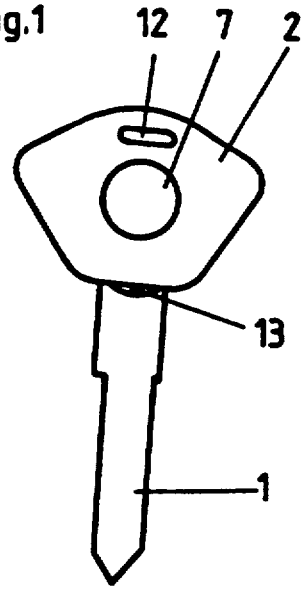
Figure 2:
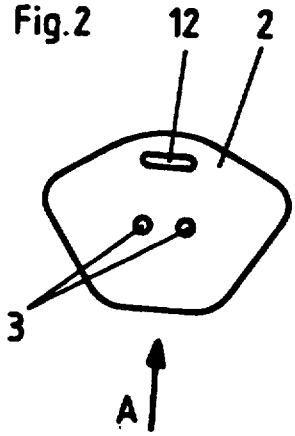
FIG. 2 the head in plan view after the removal of the fixing means for the assembled key, FIG. 3 a side elevation of the head in the direction of the arrow A according to FIG. 2, FIG. 4 part of the fixing means, FIG. 5 a further part of the fixing means and FIG. 6 the shaft in plan view.
Figure 5:
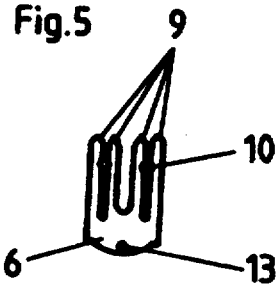
Figure 3:
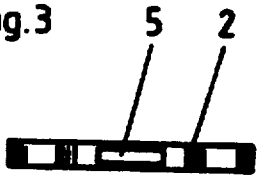
Figure 6:
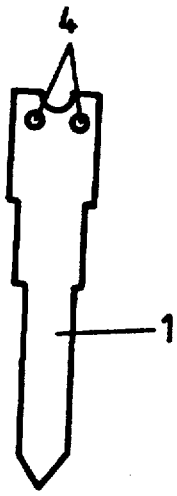
Figure 4:
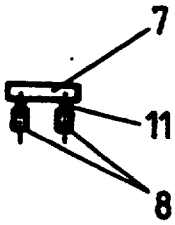

The key, according to the invention, in the illustrated form comprises a flat shaft 1 and a substantially flat head 2, releasably connected to the shaft 1. For that purpose the head and the shaft each comprise two matching holes 3, 4 side-by-side which, once the shaft 1 has been inserted into a slot 5 of the head, are in mutual alignment. The slot 5 is of such height that it permits the tight insertion there into of the shaft 1 and thereabove a clamping plate 6.

In order to secure the inserted shaft 1 in the slot 5 against withdrawal, a small plate 7 is provided comprising two pins 8 adapted to be inserted into the aligned apertures 3, 4. In order to prevent an inadvertent withdrawal of the small plate 7, from the head 2, a clamping plate 6 is provided which for each of the pins comprises a pair of prongs having a spring action, the prongs 9 with their spring action forming a snap closure in that, on the inside they each comprise a notch 10, which enter into snap engagement with corresponding notches 11, circumferential grooves, or the like, of the pin 8, after the insertion of the clamping plate 6 into the slot 5. The notches 10 are in mutual alignment. The notches 11, circumferential grooves or the like are preferably provided in the root region of the pins 8 and have a height which approximately corresponds to the thickness of the slot wall which includes the apertures 3, plus the thickness of the clamping plate 6. For inserting a removal tool (not shown), the clamping plate 6 at one end thereof, which slightly projects from the slot 5, comprises a hole 13. In this manner, it is possible to select a thickness for the clamping plate 6 such that the clamping plate 6 jointly with the shaft 1 is held so firmly in the slot 5 that any falling out of the clamping plate 6, or any easy withdrawal thereof, is prevented.

The release of the shaft 1 from the head 2 proceeds by means of an appropriate tool by means of which the clamping plate 6 is withdrawn from the slot 5 against the spring engagement of the prongs 9 with the pins 8. For that purpose a hole 13 is provided at the end of the clamping plate 6 which, in the assembled state of the key as shown in FIG. 1, projects from the head 2 sufficiently so as to permit the insertion of a clamping plate removal tool. Obviously, removal of clamping plate 6 permits the release of shaft 1 from head 2 by reversing the assembly procedure given above.

The construction of the key according to the invention, serves to satisfy fashion and vanity purposes but also offers the opportunity when switching to a different vehicle to fit the head 2 to a different shaft 1. The small plate 7 can be marked on the exposed side with the vehicle registration number. In addition, the construction according to the invention offers the possibility to reuse the head 2 which is made of gold, silver or platinum for other purposes, for example to convert it into a piece of jewellery.

It stands to reason that within the scope of the invention various constructional modifications can be performed. Thus the releasable locking engagement between the shaft 1 and the head 2 can be attained in a manner different from that described.

For example the number of holes 3, 4, the clamping plate 6 and also the small locking plate 7 can be designed differently. The configuration of the head 2 is likewise left to the designer. In all cases it preferably includes an aperture 12 for threading the key onto a key ring.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. A flat key comprising a flat head (2), a shaft (1), and a small plate (7) with pins (8) depending from a face of the small plate (7) the shaft (1) adapted to be inserted into the flat head (2) and to be releasably fixed therein, wherein the head (2) is made in one piece and has a narrow side with a slot (5) therein, and the shaft (1) is adapted to be inserted into the slot (5) entering from the narrow side of the head (2), the shaft (1) and the head (2) comprising matching apertures (3, 4) through which the pins (8) associated with the small plate (7) can be inserted to bring about a releasable connection of the shaft (1) to the head (2), wherein in order to secure the small plate (7) against inadvertent withdrawal by the removal of pins (8) from the apertures (3, 4) a clamping plate (6) is provided which is inserted into the slot (5) together with the shaft (1) and which has formations which engage matching formations of the pins (8) with a snap action.

2. The flat key according to claim 1, wherein the clamping plate for each of the pins (8) comprises a corresponding number of pairs of prongs, the prongs (9), after the insertion of the clamping plate (6) with the shaft (1) into the slot (5), embrace the pins (8) and comprise a snap locking means which enters into snap engagement with a counter-locking formation of the pins (8).

3. The flat key according to claim 2, wherein the prongs (9) comprise notches (10), by means of which surrounding edges of the walls of the prongs (9) engage with a snap action into opposing depressions of the pins (8).

4. The flat key according to claim 1, wherein the clamping plate (6), at an end thereof projecting from the head (2), comprises an opening (13) for the insertion therein of a tool for the withdrawal of the clamping plate (6) from the slot (5).

* * * * *

UNITED STATES PATENT AND TRADEMARK OFFICE

CERTIFICATE OF CORRECTION

PATENT NO. : 5,383,345

DATED : Jan. 24, 1995

INVENTOR(S) : Christine Kallinger-Prskawetz-Jacobsen geb. Ulm

It is certified that error appears in the above-indentified patent and that said Letters Patent is hereby corrected as shown below:

On the title page, item [19], please change the inventor's name from "Kallinger-Prskawetz-Jacobsen" to --Kallinger-Prskawetz-Jacobsen geb. Ulm--.

On the title page, item [76], please change the inventor's name from "Christine Kallinger-Prskawetz-Jacobsen" to --Christine Kallinger-Prskawetz-Jacobsen geb. Ulm--.

Signed and Sealed this

Twentieth Day of June, 1995

*Attest:*

*Attesting Officer*

BRUCE LEHMAN

*Commissioner of Patents and Trademarks*